US005635908A

United States Patent [19]

Soper

[11] Patent Number: 5,635,908

[45] Date of Patent: Jun. 3, 1997

[54] PORTABLE AUDIO, ALARM, ELECTRIC STUN AND SPRAY DETERRENT APPARATUS

[76] Inventor: Mary M. Soper, 140 N. Ocean Ave., Baypoint, N.Y. 11705

[21] Appl. No.: 265,970

[22] Filed: Jun. 27, 1994

[51] Int. Cl.[6] ..... G08B 13/00

[52] U.S. Cl. ..... 340/574; 222/3; 200/61.19; 340/691; 340/693; 361/232; 455/344

[58] Field of Search ..... 340/573, 574, 340/691, 693; 455/344; 200/61.19; 222/3, 39; 239/72; 273/84 ES; 361/232

[56] References Cited

U.S. PATENT DOCUMENTS

| | | | |
|---|---|---|---|
| 3,440,635 | 4/1969 | Hull | 340/574 X |
| 3,722,788 | 3/1973 | Petrecz | 273/84 R X |
| 5,258,746 | 11/1993 | Leitten et al. | 340/574 |
| 5,289,164 | 2/1994 | Novak | 340/574 |
| 5,392,029 | 2/1995 | Chang | 340/574 |
| 5,512,881 | 4/1996 | Majmudar | 340/574 |

*Primary Examiner*—Thomas Mullen

[57] ABSTRACT

Said present invention relates to a portable audio apparatus having an alarm, electric stun and spray deterrent. Said primary and radically different feature of this device from those currently patented and/or on said market is that said self-protection devices are incorporated in a portable audio apparatus. This device allows said user to enjoy audio while having a feeling of security. Activation of said security system occurs by pulling said cord or releasing one's grip which will also pull said cord. Once activated, said present invention is in said constant on position. In said constant on position said alarm will sound and said electric stun will be operable. In addition, said present invention allows said user at any time to depress a trigger to release an eye irritant to resist an attacker.

10 Claims, 2 Drawing Sheets

PORTABLE AUDIO, ALARM, ELECTRIC STUN AND SPRAY DETERRENT APPARATUS

BACKGROUND OF THE INVENTION

1. Field of the Invention:

The present invention relates to alarm devices, and more particularly to a portable, personal alarm system which incorporates a loud audio alert that, when engaged, is unable to be removed or terminated without the cooperation of the owner.

2. Description of the Prior Art:

A hand held audible alarm is useful in areas having a high incidence of robberies and assault for warding off or at least distracting would be attackers.

Various alarm devices currently exist, however, they all require that the device be carried as a separate item on the person.

Numerous innovations for a hand held audible alarm have been provided in the prior art that are described as follows. Even though these innovations may be suitable for the specific individual purposes to which they address, they differ from the present invention as hereinafter contrasted.

U.S. Pat. No. 4,759,309

Passive Personal Alarm Device

Victor C. Zediker

A passive air, gas aerosol or pressurized fluid activated personal self-protection screech alarm device that is armed prior to the person utilizing it entering into a potentially dangerous area or situation. The primary and radically different feature of this device from those currently patented and/or on the market is that no action is demanded of the person carrying it in the event of an attack other than the natural inclination to release ones grip. Releasing ones grip on the aerosol can and lever and dropping the device then activates an irrevocable screech alarm. This device plays to the psychological implications of attack in that if active, overt action is taken by the person who is the subject of a rape, for example, the attacker oftentimes becomes more violent. With this device, the natural inclination to show fright and drop whatever one is carrying serves to activate the alarm. More particularly, when the device is released from the hand, a spring loaded lever (similar in feature to a military hand grenade) flies up and away from the can and becomes separated. That in turn releases a spring loaded fly-away plug valve allowing the propellant to escape and sound the alarm signaling portion of the device.

U.S. Pat. No. 4,4044,712

Pressurized Fluid Powered Horn

Manuel Goodman; Boubene M. Jaremus

A hand-held pressurized fluid powered audible alarm includes a housing in which is mounted a pressurized container having a deflection responsive valve and outlet member projecting therefrom. A horn body is mounted on and in fluid communication with the member and a spring loaded plunger carried by the housing is provided to contact and displace the horn body thereby deflecting the member to supply pressurized fluid for sounding the alarm. The plunger is normally retained space from the alarm by a removable pin passing transversely through the plunger shaft. A ring coupled to the pin is pulled to rapidly remove the pin and irreversibly activate the alarm.

U.S. Pat. No. 5,075,671

Personal Alarm System

Robert Livingston, III

A portable, personal alarm system which incorporates a loud audio alert that, when engaged, is unable to be removed from the user, or terminated without the cooperation thereof. The preferred embodiment of the present invention comprises a small, hand-held alarm system having a strap with a locking mechanism for securely affixing the system to the user, compressed gas containment or electrical power for providing a loud audio horn alert, a locator light for signalling the location of the user in dark areas, and a mechanism for selectively locking the horn alert in the "on" operating position which cannot be reactivated without unlocking the strap which uses a precoded combination type lock. In use the push button end is placed within the palm so that the push button lies right under the fingers, with the main body extending up along side of the inner side of the wrist.

U.S. Pat. No. 5,257,007

Portable Security System

David J. Steil, Yardley; Gregory J. Borsos

A fully hand portable security system includes a plurality of radio transmitter equipped detectors with batteries, configured to generate one or more radio signals indicating the sensing of a potentially hazardous environmental condition by the detector and a central controller including a weather resistant housing including a radio receiver, a processor and power supply circuitry, operator audible and visible alerting devices and connectors activating or deactivating various optional or other devices at the location and transmitting alarm or other trouble warning message to remote location. The controller is configured to be powered by either AC or DC power supply, including an external, hand portable battery providing a multiday power supply for operating the system for at least one week. Operation of the system is as simple as carrying the components to the area to be protected, hand install the detectors about the area, connecting the controller to the selected power supply and turning the controller on. The preferred system can be configured to automatically initialize itself and to begin surveillance operations. The system is removed by simply picking up and carrying away the detectors and controller after coupling the controller from a power supply, if necessary.

SUMMARY OF THE INVENTION

Briefly, the hereinafter mentioned and other objects of this invention are satisfied by providing a hand carried, audio personal alarm device which includes an electric stun and spray deterrent.

The device is armed by the person pulling the activation cord passively or actively. Once armed the device is in the constant on position and can now be used for electric stun. A person does not have to activate the device to have protection. The device provides a deterrent spray that can be used at any time.

It is an object of the present invention to provide a portable audio system.

It is another object of the present invention to provide a person with a spray deterrent to repel the attacker.

It is another object of the present invention to provide a person with an electric stun to repel the attacker.

It is another object of the present invention to provide a personal alarm system which, when activated by the user, is irreversible by the attacker.

Accordingly, it is an object of the present invention to provide a portable audio system with a personal security system.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

BRIEF LIST OF REFERENCE NUMERALS

UTILIZED IN THE DRAWING

10—portable audio, alarm, electric stun and spray deterrent apparatus 10
10A—top alarm dead man's switch housing 10A
10B—middle alarm dead man's switch housing 10B
10C—bottom alarm dead man's switch housing 10C
12—play button 12
14—fast forward and rewind button 14
16—stop button 16
18—spray deterrent cylinder 18
18A—spray deterrent nozzle 18A
18B—spray deterrent actuator 18B
20—alarm dead man's switch 20
20A—alarm dead man's switch top member 20A
20B—alarm dead man's switch cylinder 20B
20C—alarm dead man's switch battery contact lead 20C
20D—alarm dead man's switch alarm contact lead 20D
20E—alarm dead man's switch spring holder 20E
20F—alarm dead man's switch spring 20F
20G—alarm dead man's switch spacer 20G
20H—alarm dead man's switch spacer activation direction 20H
20I—alarm dead man's switch activation direction 20I
20J—alarm dead man's switch spacer cord 20J
22—battery 22
24—alarm 24
26—high voltage electric generation means 26
26A—positive high voltage lead 26A
26B—negative high voltage lead 26B
28—speaker 28

DETAILED LIST OF REFERENCE NUMERALS

UTILIZED IN THE DRAWING

10—portable audio, alarm, electric stun and spray deterrent apparatus 10 having an alarm 24, and spray deterrent cylinder 18

10A—top alarm dead man's switch housing 10A which holds alarm dead man's switch spacer 20G and alarm dead man's switch top member 20A

10B—middle alarm dead man's switch housing 10B which holds alarm dead man's switch cylinder 20B and alarm dead man's switch alarm contact lead 20D

10C—bottom alarm dead man's switch housing 10C which holds alarm dead man's switch spring 20F

12—play button 12 which provides standard tape play function

14—fast forward and rewind button 14 which provides standard movement of tape in forward or reverse directions

16—stop button 16 which provides standard stopping of movement of tape

18—spray deterrent cylinder 18 activated by spray deterrent actuator 18B

18A—spray deterrent nozzle 18A which releases deterrent spray from spray deterrent cylinder 18

18B—spray deterrent actuator 18B which when depressed releases deterrent spray from spray deterrent cylinder 18 through spray deterrent nozzle 18A

20—alarm dead man's switch 20 which is activated by pulling alarm dead man's switch spacer cord 20J in alarm dead man's switch spacer activation direction 20H which removes alarm dead man's switch spacer 20G causing alarm dead man's switch battery contact lead 20C to come in contact with alarm dead man's switch alarm contact lead 20D, thereby, activating alarm 24

20A—alarm dead man's switch top member 20A is held in place by alarm dead man's switch spacer 20G which when removed causes alarm dead man's switch top member 20A to move, thereby activating alarm 24

20B—alarm dead man's switch cylinder 20B holds alarm dead man's switch battery contact lead 20C

20C—alarm dead man's switch battery contact lead 20C which when brought in contact with alarm dead man's switch alarm contact lead 20D activates alarm 24

20D—alarm dead man's switch alarm contact lead 20D which when brought in contact with alarm dead man's switch battery contact lead 20C activates alarm 24

20E—alarm dead man's switch spring holder 20E which holds alarm dead man's switch spring 20F to alarm dead man's switch cylinder 20B

20F—alarm dead man's switch spring 20F which provides tension to bring together alarm dead man's switch battery contact lead 20C with alarm dead man's switch alarm contact lead 20D

20G—alarm dead man's switch spacer 20G which when pulled in alarm dead man's switch spacer activation direction 20H allows alarm dead man's switch 20 to activate alarm 24

20H—alarm dead man's switch spacer activation direction 20H which is the direction to pull alarm dead man's switch spacer cord 20J to activate alarm 24

20I—alarm dead man's switch activation direction 20I which is the direction alarm dead man's switch 20 travels to activate alarm 24

20J—alarm dead man's switch spacer cord 20J which is the cord pulled to remove alarm dead man's switch spacer 20G to activate alarm 24

22—battery 22 which provides the power to operate alarm 24

24—alarm 24 which is powered by battery 22 and is activated by pulling alarm dead man's switch spacer cord 20J

26—high voltage electric generation means 26 which is powered by battery 22, activated by the removal alarm dead man's switch spacer 20G and discharges when both positive high voltage lead 26A and negative high voltage lead 26B are contacted

26A—positive high voltage lead 26A connected to high voltage electric generation means 26

26B—negative high voltage lead 26B connect to high voltage electric generation means 26

28—speaker 28 which allows audio signal to be transmitted from portable audio, alarm, electric stun and spray deterrent apparatus 10

DETAILED DESCRIPTION OF THE PREFERRED EMBODIMENT

Figure 1:
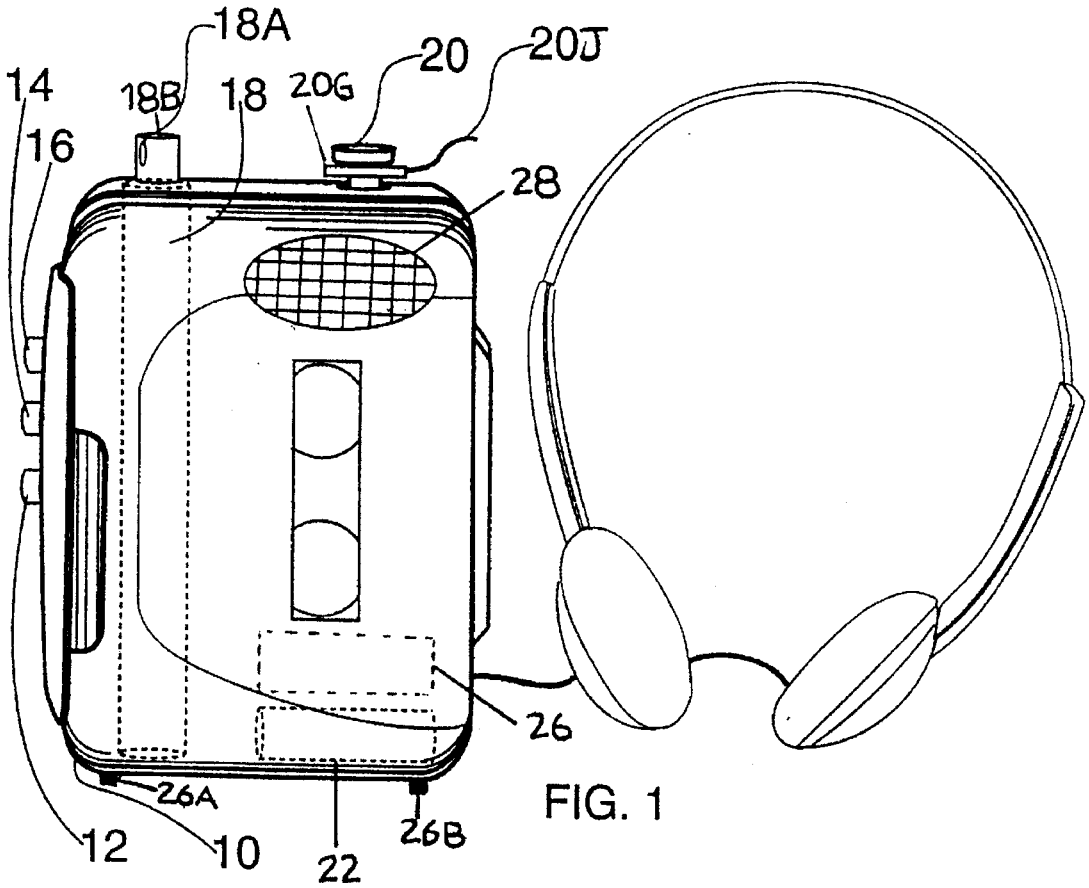
FIG. 1 is a perspective view of portable audio, alarm, spray deterrent and electrical deterrent apparatus.

Firstly, referring to FIG. 1 being a perspective view of a portable audio, alarm, electric deterrent and spray deterrent apparatus 10 exhibiting said following features: play button 12 providing a standard tape play function; fast forward and rewind button 14 providing standard movement of tape in forward or reverse directions; stop button 16 providing standard stopping of movement of tape; spray deterrent cylinder 18 activated by spray deterrent actuator 18B; spray deterrent nozzle 18A releasing deterrent spray from spray deterrent cylinder 18; spray deterrent actuator 18B which when depressed releases deterrent spray from spray deterrent cylinder 18 through spray deterrent nozzle 18A; alarm dead man's switch 20 being activated by pulling alarm dead man's switch spacer cord 20J; alarm dead man's switch spacer 20G which when pulled out allows alarm dead man's switch 20 to activate alarm 24; alarm dead man's switch spacer cord 20J which, when pulled, removes alarm dead man's switch spacer 20G, thus activating alarm 24; high voltage electric generation means 26 being powered by battery 22, activated by said removal of alarm dead man's switch spacer 20G, and discharging when both positive high voltage lead 26A and negative high voltage lead 26B are contacted; positive high voltage lead 26A connected to high voltage electric generation means 26; negative high voltage lead 26B connected to high voltage electric generation means 26; and speaker 28 allowing audio signal to be transmitted from portable audio, alarm, electric stun and spray deterrent apparatus 10.

Figure 2:
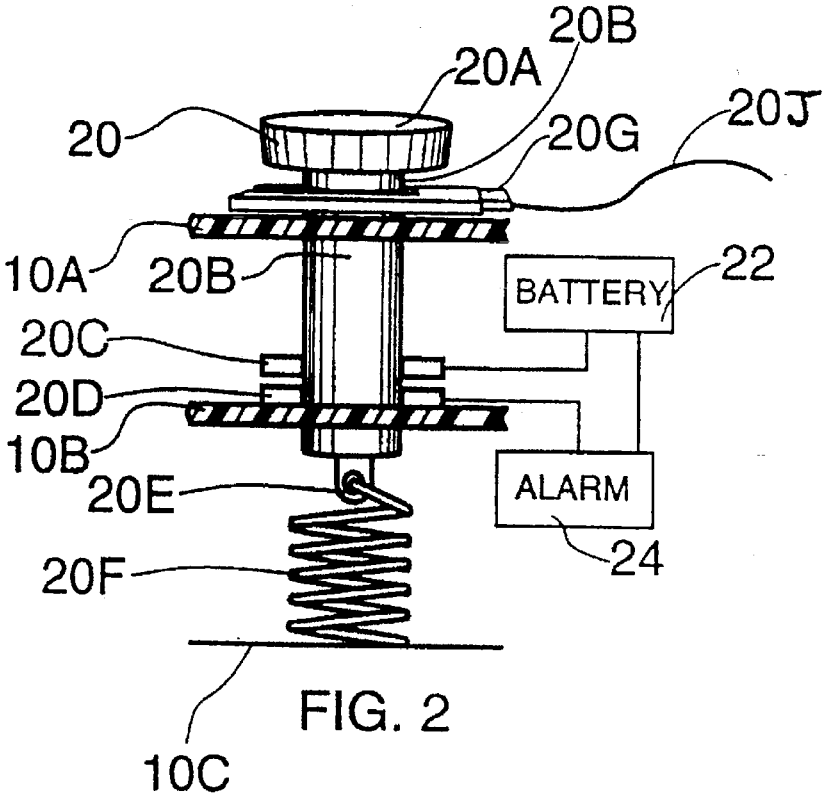
FIG. 2 is a perspective view of alarm dead man's switch with the spacer pushed in to keep battery and alarm contact apart to prevent alarm activation.

Now, referring to FIG. 2 being a perspective view of alarm dead man's switch 20 with alarm dead man's switch spacer 20G pushed in, thus keeping alarm dead man's switch battery contact lead 20C and alarm dead man's switch alarm contact lead 20D apart, thus preventing alarm 24 from activating. Switch 20 exhibits the following features: top alarm dead man's switch housing 10A holding alarm dead man's switch spacer 20G and alarm dead man's switch top member 20A; middle alarm dead man's switch housing 10B providing an opening for and holding alarm dead man's switch cylinder 20B and holding alarm dead man's switch alarm contact lead 20D; bottom alarm dead man's switch housing 10C which holds alarm dead man's switch spring 20F; alarm dead man's switch 20 being activated by pulling alarm dead man's switch spacer cord 20J in alarm dead man's switch spacer activation direction 20H, thus removing alarm dead man's switch spacer 20G which held switch top member 20A in place, thus causing alarm dead man's switch battery contact lead 20C to come in contact with alarm dead man's switch alarm contact lead 20D, thereby, activating alarm 24; alarm dead man's switch top member 20A is held in place by alarm dead man's switch spacer 20G, which, when removed causes alarm dead man's switch top member 20A to move in the direction of 20I, thereby activating alarm 24; alarm dead man's switch cylinder 20B holds alarm dead man's switch battery contact lead 20C; alarm dead man's switch battery contact lead 20C which when brought in contact with alarm dead man's switch alarm contact lead 20D activates alarm 24; alarm dead man's switch alarm contact lead 20D which when contacted by alarm dead man's switch battery contact lead 20C activates alarm 24; alarm dead man's switch spring holder 20E holding alarm dead man's switch spring 20F to alarm dead man's switch cylinder 20B; alarm dead man's switch spring 20F providing tension to bring alarm dead man's switch battery contact lead 20C in contact with alarm dead man's switch alarm contact lead 20D; alarm dead man's switch spacer 20G which, when pulled in alarm dead man's switch spacer activation direction 20H, allows alarm dead man's switch 20 to move in direction 20I, thus activating alarm 24; alarm dead man's switch spacer activation direction 20H being said direction to pull alarm dead man's switch spacer cord 20J to activate alarm 24; alarm dead man's switch activation direction 20I being said direction alarm dead man's switch 20 travels to activate alarm 24; alarm dead man's switch spacer cord 20J being said cord to pull to remove alarm dead man's switch spacer 20G, thus activating alarm 24; battery 22 providing said power to operate alarm 24; alarm 24 is powered by battery 22 and is activated by pulling alarm dead man's switch spacer cord 20J.

Figure 3:
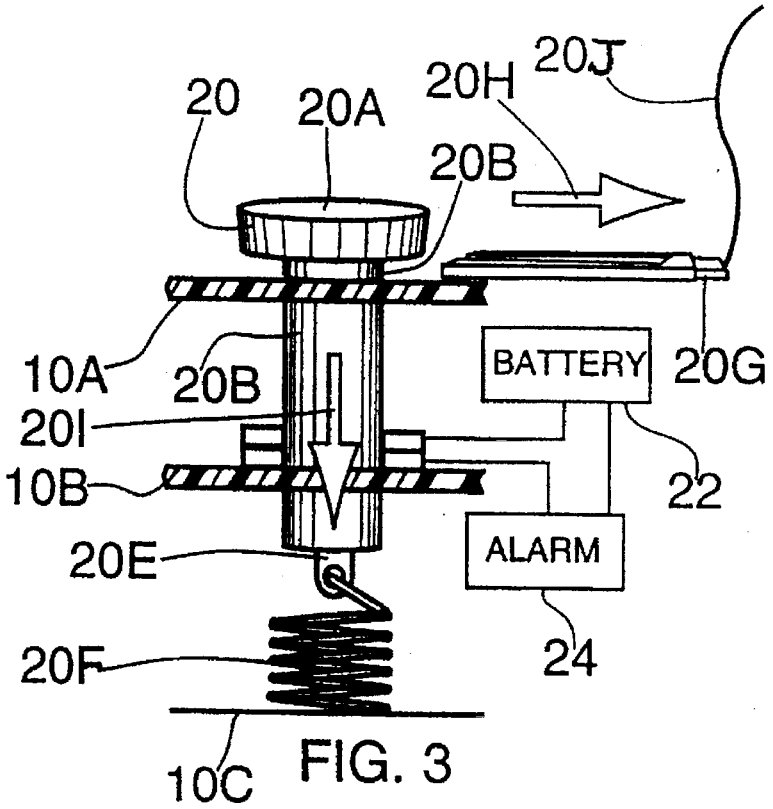
FIG. 3 is a perspective view of alarm dead man's switch with spacer pulled out which allows tension in spring to bring battery and alarm contact together, thereby activating alarm.

Now referring to FIG. 3 being a perspective view of alarm dead man's switch 20 with alarm dead man's switch spacer 20G pulled out which allows tension in alarm dead man's switch spring 20F to bring alarm dead man's switch battery contact lead 20C into contact with alarm dead man's switch alarm contact lead 20D, thereby activating alarm 24. This figure exhibits the following features: top alarm dead man's switch housing 10A which holds alarm dead man's switch spacer 20G and alarm dead man's switch top member 20A; middle alarm dead man's switch housing 10B which provides an opening for and holds alarm dead man's switch cylinder 20B and holds alarm dead man's switch alarm contact lead 20D; bottom alarm dead man's switch housing 10C which holds alarm dead man's switch spring 20F; alarm dead man's switch 20 being activated by pulling alarm dead man's switch spacer cord 20J in alarm dead man's switch spacer activation direction 20H which removes alarm dead man's switch spacer 20G causing alarm dead man's switch battery contact lead 20C to come in contact with alarm dead man's switch alarm contact lead 20D, thereby activating alarm 24; alarm dead man's switch top member 20A is held in place by alarm dead man's switch spacer 20G which when removed causes alarm dead man's switch top member 20A to move, in direction 20I, thereby activating alarm 24; alarm dead man's switch cylinder 20B holds alarm dead man's switch battery contact lead 20C; alarm dead man's switch battery contact lead 20C which when brought in contact with alarm dead man's switch alarm contact lead 20D activates alarm 24; alarm dead man's switch alarm contact lead 20D which when contacted by alarm dead man's switch battery contact lead 20C activates alarm 24; alarm dead man's switch spring holder 20E which holds alarm dead man's switch spring 20F to alarm dead man's switch cylinder 20B; alarm dead man's switch spring 20F providing tension to bring alarm dead man's switch battery contact lead 20C in contact with alarm dead man's switch alarm contact lead 20D; alarm dead man's switch spacer 20G which when pulled in alarm dead man's switch spacer activation direction 20H allows alarm dead man's switch 20 to move in direction 20I, thus activating alarm 24; alarm dead man's switch spacer activation direction 20H being said direction to pull alarm dead man's switch spacer cord 20J to activate alarm 24; alarm dead man's switch activation direction 20I being said direction alarm dead man's switch 20 travels to activate alarm 24; alarm dead man's switch spacer cord 2OJ being said cord to pull to remove alarm dead man's switch spacer 20G, thus activating alarm 24; battery 22 providing said power to operate alarm 24; alarm 24 being powered by battery 22 and is activated by pulling alarm dead man's switch spacer cord 20J. The audio producing means can be a radio, a tape player, or a laser disc player. The alarm 24 can comprise an audio and/or a visual alarm producing means. The spray deterrent causes temporary blindness and can be a mace composition, a pepper composition, or any substance which will cause temporary blindness or eye irritation. The spray deterrent is released by gas compressed by a pump. The housings 10A, 10B, and 10C are made from a waterproof material such as plastic, epoxy, carbon graphite, fiberglass, metal, and metal alloys.

It will be understood that each of said elements described above, or two or more together, may also find a useful application in other types of constructions differing from said type described above.

While said invention has been illustrated and described as embodied in a portable audio apparatus, it is not intended to be limited to said details shown, since it will be understood that various omissions, modifications, substitutions and changes in said forms and details of said device illustrated and in its operation can be made by those skilled in said art without departing in any way from said spirit of said present invention.

Without further analysis, said foregoing will so fully reveal said gist of said present invention that others can, by applying current knowledge, readily adapt it for various applications without omitting features that, from said standpoint of prior art, fairly constitute essential characteristics of said generic or specific aspects of this invention.

What is claimed as new and desired to be protected by Letters Patent is set forth in said appended claims.

I claim:

1. A combination portable audio, alarm, electric stun, and spray deterrent apparatus comprising:

A) a housing;

B) a high voltage electric generation means powered by a power source, the electric generation means being activated by the removal of a switch spacer from the housing which closes an electronic switch, the electric generation means discharging when both a positive high voltage lead and a negative high voltage lead are connected; and C) an audio producing means contained within the housing, the audio producing means having a speaker which emanates sounds, the audio producing means being electronically connected to the power source.

2. The combination described in claim 1, wherein the audio producing means is selected from the group consisting of a radio, tape player, and a laser disc player.

3. The combination described in claim 1, wherein the housing is constructed of a material selected from the group consisting of plastic, plastic composite, epoxy, carbon graphite, fiberglass, metal and metal alloy.

4. The combination described in claim 1, wherein the housing is waterproof.

5. The combination described in claim 1, wherein the housing is made from water resistant material.

6. The combination described in claim 1, wherein the electronic switch further comprises:

a) a top member with a spring means, b) a cylinder, and c) a switch spacer cord connected to the spacer;

the switch spacer being disposed between an exterior surface of the housing and the top member which prevents the top member from displacing towards the housing thereby preventing activation of the electronic switch, the switch having electrical contact leads of which one is attached to the cylinder, the contact leads electrically connected to the power source which is electrically connected to an alarm producing means having a sound generation means, whereby when the spacer cord is pulled, the spacer is removed and the top member is pulled toward the housing causing movement of the cylinder thereby permitting closure of the switch and activation of the sound generation means.

7. The combination described in claim 1, further comprising a visual alarm producing means and an audible alarm producing means.

8. The combination described in claim 1, further comprising a spray deterrent container affixed to the housing, the spray deterrent container having a spray deterrent actuator, the spray deterrent actuator having a spray deterrent nozzle, the spray deterrent container containing a spray deterrent, the spray deterrent being released from the container when the spray deterrent actuator is depressed, releasing the deterrent from the spray deterrent container through the spray deterrent nozzle.

9. The combination described in claim 8, wherein the spray deterrent is a substance selected from the group consisting of a mace composition, a pepper composition, and a substance which will cause temporary blindness and eye irritation.

10. The combination described in claim 8, wherein the spray deterrent is released by gas compressed by a pump.

* * * * *